US006543534B2

(12) United States Patent
Erick

(10) Patent No.: US 6,543,534 B2
(45) Date of Patent: Apr. 8, 2003

(54) DOWNHOLE JET PUMP

(75) Inventor: Leonard Larry Erick, Camrose (CA)

(73) Assignee: Coil-Tech Services Ltd., Camrose (CA)

( * ) Notice: Subject to any disclaimer, the term of this patent is extended or adjusted under 35 U.S.C. 154(b) by 0 days.

(21) Appl. No.: 09/823,967

(22) Filed: Mar. 29, 2001

(65) Prior Publication Data

US 2002/0139525 A1 Oct. 3, 2002

(30) Foreign Application Priority Data

Mar. 2, 2001 (CA) ..... 2339684

(51) Int. Cl.[7] ..... E21B 21/16

(52) U.S. Cl. ..... 166/90.1; 166/63; 166/68.5; 166/105.6

(58) Field of Search ..... 166/90.1, 75.12, 166/105.6, 370, 372, 68.5, 77.2, 242.2, 267, 401, 63

(56) References Cited

U.S. PATENT DOCUMENTS

| | | | | | |
|---|---|---|---|---|---|
| 3,004,594 | A | | 10/1961 | Crawford | 166/11 |
| 3,522,847 | A | | 8/1970 | New | 166/60 |
| 4,501,329 | A | | 2/1985 | DePriester | 166/292 |
| 4,988,389 | A | * | 1/1991 | Adamache et al. | 166/302 |
| 5,181,796 | A | | 1/1993 | DeYoung | 405/128 |
| 5,335,728 | A | * | 8/1994 | Strahan | 166/267 |
| 5,402,847 | A | | 4/1995 | Wilson et al. | 166/263 |
| 5,488,990 | A | | 2/1996 | Wadleigh et al. | 166/260 |
| 5,656,136 | A | * | 8/1997 | Gayaut et al. | 166/302 |
| 5,663,121 | A | | 9/1997 | Moody | 507/102 |
| 6,041,873 | A | | 3/2000 | Michael | 175/71 |
| 6,176,896 | B1 | | 1/2001 | Dementhon et al. | 95/14 |
| 6,209,641 | B1 | * | 4/2001 | Stevenson | 166/266 |
| 6,382,321 | B1 | * | 5/2002 | Bates et al. | 166/372 |
| 6,412,559 | B1 | | 7/2002 | Gunter et al. | 166/271 |

* cited by examiner

*Primary Examiner*—David Bagnell
*Assistant Examiner*—Zakiya Walker
(74) *Attorney, Agent, or Firm*—Frank J. Dykas; Stephen M. Nipper; Robert L. Shaver

(57) ABSTRACT

A wellsite pumping system, comprising a gas processing system including a source of compressed gas, the source of compressed gas having a low pressure inlet and a high pressure outlet, coil tubing connected to the high pressure outlet of the gas processing system, the coil tubing including a first tubing string connected to the high pressure outlet and a second tubing string running parallel to the first tubing string and having an opening for entry of fluid at a remote end from the high pressure outlet; and a venturi connecting the second tubing string to the first tubing string such that, in operation, passage of gas through the venturi from the first tubing string draws production fluid into the second tubing string. Preferably, the second tubing string is suspended within the first tubing string. The venturi may be formed by a horizontal passageway communicating with a vertical passageway with a restriction.

5 Claims, 2 Drawing Sheets

DOWNHOLE JET PUMP

BACKGROUND OF THE INVENTION

This invention relates to equipment used for producing wells.

Oil and gas wells have been produced by a jet pump in which inner and outer strings of tubing are connected downhole using a venturi, and liquid flow through the outer tubing string then through the venturi into the inner tubing string draws production fluid into the inner tubing through an opening into the inner tubing. This process has been found to work, but requires a suitable liquid.

Cleaning out wells conventionally with a coiled tubing unit is accomplished by forcing compressed air/gas down the coiled tubing to the bottom of the well and returning the fluid/fill up the annulus between the coiled tubing and the wells original production casing. The fluids are carried up the annulus in slugs causing a pressure build-up in the lower portion of the well. This pressure build up may force fluids, fill, and air back into the producing zone, which may cause formation damage. Wells with production casing larger than four and one half inch are difficult to clean out due to reduced annular velocity of the compressed air. To clean a well out in this manner, the casing gas is vented to atmosphere through the entire job. This is expensive and not environmentally friendly. This invention is directed to providing an improved pumping system.

SUMMARY OF THE INVENTION

There is therefore provided in accordance with the invention a wellsite pumping system, comprising a gas processing system including a source of compressed gas, the source of compressed gas having a low pressure inlet and a high pressure outlet, coil tubing connected to the high pressure outlet of the gas processing system, the coil tubing including a first tubing string connected to the high pressure outlet and a second tubing string running parallel to the first tubing string and having an opening for entry of fluid at a remote end from the high pressure outlet; and a venturi connecting the second tubing string to the first tubing string such that, in operation, passage of gas through the venturi from the first tubing string draws production fluid into the second tubing string. Preferably, the second tubing string is suspended within the first tubing string. The venturi may be formed by a horizontal passageway communicating with a vertical passageway with a restriction.

In one aspect of the invention, the source of compressed gas forms part of a wellsite inert gas injector. The inert gas injector comprises an internal combustion engine, a gas processing system connected to receive low pressure exhaust gas from the internal combustion engine, a pump within the gas processing system, the pump having a low pressure inlet for receiving exhaust gases and the pump having a high pressure outlet; and coil tubing connected to the high pressure outlet of the gas processing system. The gas processing system preferably comprises one or more of a particulate filter, exhaust cooler and exhaust separator in series, and in that order before the pump. The pump may be a compressor.

BRIEF DESCRIPTION OF THE DRAWINGS

There will now be described preferred embodiments of the invention with reference to the drawings by way of illustration, and without intending to limit the generality of the claims, in which:

DETAILED DESCRIPTION OF PREFERRED EMBODIMENTS

Figure 1:
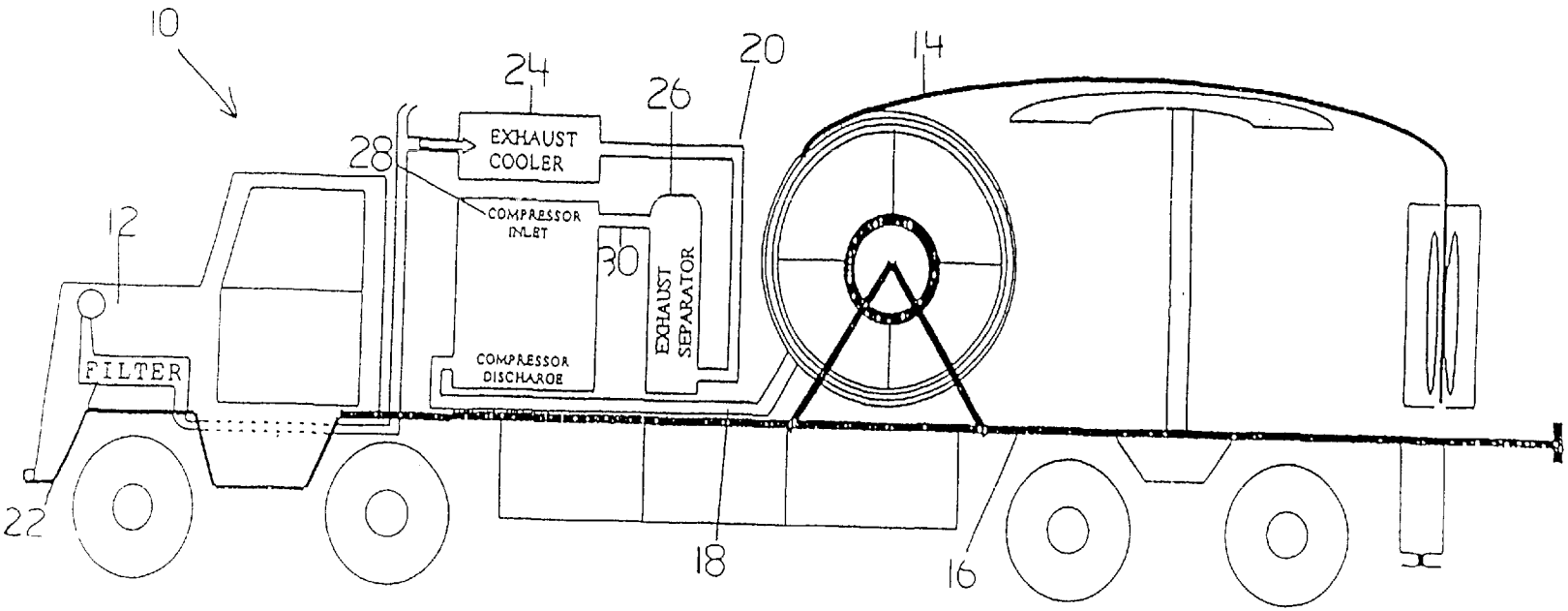
FIG. 1 is a schematic showing an embodiment of a source of compressed gas for use with an embodiment of the invention.

In this patent document, "comprising" is used in its inclusive sense, and does not exclude other elements being present in the invention to which a claim refers. Use of the indefinite article "a" before an element of a claim means that at least one of the elements is present.

A wellsite inert gas injector 10 is preferably truck mounted as shown in the figure and utilizes exhaust from the truck's internal combustion engine 12 as source of inert gas. Preferably, the engine is a diesel engine. The exhaust is provided to coil tubing 14, which is mounted on the truck deck 16 in conventional manner. A conventional connection (not shown) is used to connect the outlet 18 to the coil tubing 14. Between the engine 12 and coil tubing 14 is a gas processing system 20 that is connected to receive low pressure exhaust gas from the internal combustion engine and provide high pressure inert gas to the coil tubing 14 through outlet 18. Low pressure and high pressure are relative terms. What matters is that gas at the high pressure outlet 18 has sufficient pressure for use down a well.

The gas processing system 20 incorporates several modules to process the gas to make it suitable for downhole use. The modules are connected in series by conventional gas tight couplings. First, on the exhaust outlet of the engine 12, is a catalytic diesel particulate filter 22, which may be one manufactured by Nett Technologies Inc. Details of the Nett diesel filter are available from Nett, and briefly described in the following. The Nett diesel filter 22 utilizes cordierite wall-flow monoliths to trap the soot produced by heavy-duty diesel engines. A cylindrical filter element in the filter 22 has of many square parallel channels running in the axial direction, separated by thin porous walls. The channels are open at one end, but plugged at the other. Particulate laden exhaust gases are forced to flow through the porous walls. Gas is able to escape through the pores in the wall material. Particulates, however, are too large to escape and are trapped in the filter walls. A proprietary noble metal catalyst is coated onto the inside surface of the filter monolith. The catalyst lowers the soot combustion temperature to allow the filter to regenerate. The accumulated soot is oxidized in the filter during regular operation of the engine. Periods with exhaust temperatures of at least 350–400 degrees Fahrenheit are necessary for proper filter regeneration. However, so far as this invention is concerned in its broadest preferred aspect, a particulate filter is required to sufficiently clean the exhaust that the gas processing components are not damaged and the remaining particulate in the inert gas does not have a negative effect on the well.

Following the filter 22 is an exhaust cooler 24, for example a fin type fan driven cooler, or other suitable cooler to reduce the temperature of the gases to a temperature suitable for compression, as for example cooling the exhaust gases from about 500 degrees to 90 degrees Fahrenheit. Following the cooler 24 is a conventional liquid/gas separator 26 for removing any liquid droplets that condense out of the exhaust when it is cooled. It may be either free standing or built into the exhaust cooler. Following the separator 26 is a compressor 28 or other suitable pump with a low pressure inlet 30 and a high pressure outlet 18. The compressor 28 should compress the exhaust gas to a sufficient pressure for cleaning a well, or such other application that the invention might be used for.

The inert gas generator so described is mobile and may be taken from well site to well site. At the well site, the engine supplies nitrogen rich, essentially oxygen free, but contaminated inert gas for use in well clean out operations. The gas processing system cleans the gas for use downhole.

With an efficient internal combustion engine, it is expected that the resulting exhaust will be essentially oxygen free, with any remaining free oxygen captured by carbon monoxide to form carbon dioxide. Incorporation of other inert gases from the atmosphere besides nitrogen is acceptable. The water separator should separate out water droplets to avoid damage to the compressor, but need not render the exhaust stream free of water vapor. The exhaust stream may be 100% water saturated. The maximum preferred inlet temperature to the compressor is 10° F. above ambient. A preferred compressor is a Hurricane Compressor capable of pumping at 330 cubic feet per minute at 2000 psi.

Figure 2:
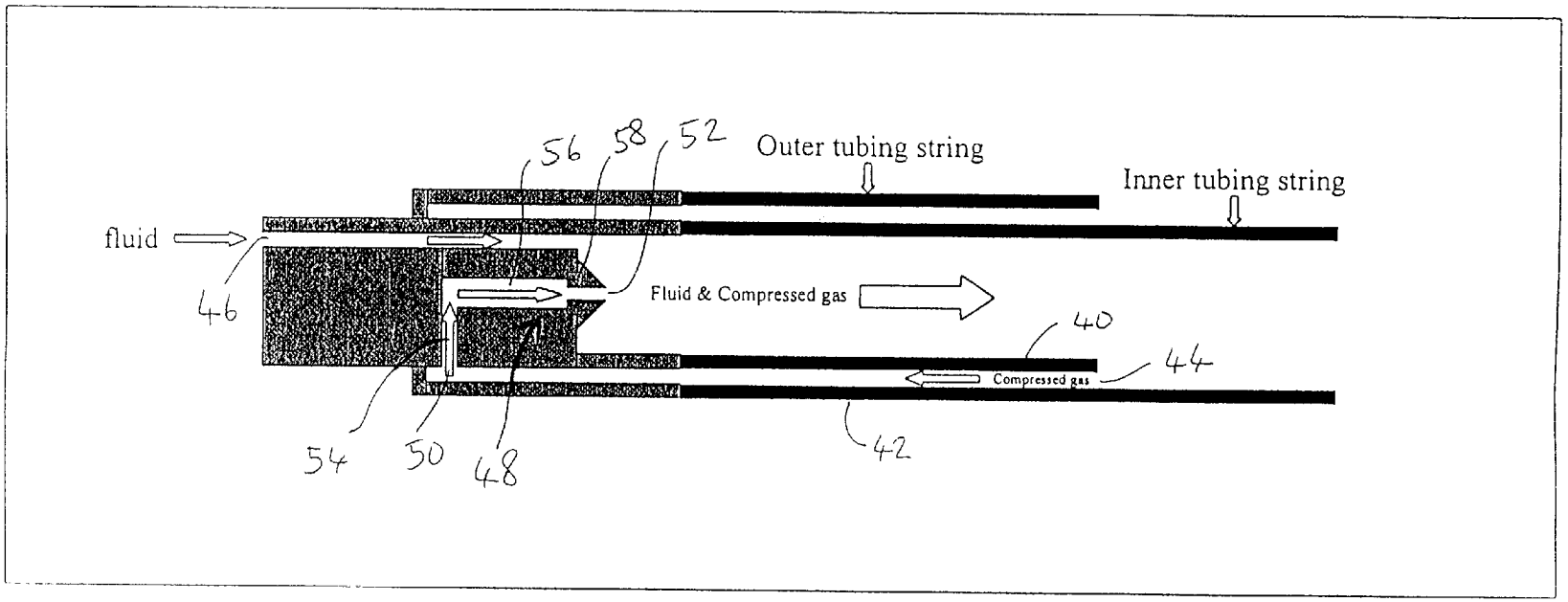
FIG. 2 is a schematic showing a down hole jet pump for use with an embodiment of the invention.

The coil tubing 14 is formed of two strings of endless tubing running in the well simultaneously (one inside the other). FIG. 2 shows the inner tubing 40 and outer tubing 42 with an annulus 44 between them. The inner tubing 40 extends below the outer tubing 42 and has an opening 46 for the flow of downhole fluid, for example production hydrocarbons, into the inner tubing 40. A venturi 48 is provided with an inlet 50 communicating with the annulus 44 and an outlet 52 communicating with the bore of the inner tubing 40. The venturi 48 may be formed by a horizontal passageway 54 communicating with a vertical passageway 56 having a restriction 58 at the outlet 52 where the flow through the venturi enters the inner tubing 40. Exhaust is pumped down the annulus 44 between the two strings 40, 42, through the venturi 48 and lifts well fluids up the inside string 40. Such a system may be used to produce oil wells.

By using a jet pump, the well need not be vented to atmosphere and would have to be taken off production to be cleaned out. Such jet pumps are known in the art in themselves, but the use of the exhaust system described would provide lower installation costs, quicker start up, less harm from sand to the pump and ready variation of production volumes from the well. This application is filed simultaneously with an application claiming the inert gas generator.

Immaterial modifications may be made to the invention described here without departing from the essence of the invention.

What is claimed is:

1. A wellsite pumping system, comprising:

a gas processing system including a source of compressed gas, the source of compressed gas having a low pressure inlet and a high pressure outlet;

coil tubing connected to the high pressure outlet of the gas processing system, the coil tubing including a first tubing string connected to the high pressure outlet and a second tubing string running parallel to the first tubing string and having an opening for entry of fluid at a remote end from the high pressure outlet;

a venturi connecting the second tubing string to the first tubing string such that, in operation, passage of gas through the venturi from the first tubing string draws production fluid into the second tubing string;

an internal combustion engine;

the gas processing system being connected to receive low pressure exhaust gas from the internal combustion engine, wherein said gas processing system comprises a particulate filter, exhaust cooler and exhaust separator in series, followed by a compressor, wherein said compressor has a low pressure inlet for receiving exhaust gases and a high pressure outlet.

2. The wellsite pumping system of claim 1 in which the first tubing string is disposed within the second tubing string.

3. A wellsite pumping system, comprising:

a gas processing system including a source of compressed gas, the source of compressed gas having a low pressure inlet and a high pressure outlet;

coil tubing connected to the high pressure outlet of the gas processing system, the coil tubing including a first tubing string connected to the high pressure outlet and a second tubing string running parallel to the first tubing string and having an opening for entry of fluid at a remote end from the high pressure outlet;

a venturi connecting the second tubing string to the first tubing string such that, in operation, passage of gas through the venturi from the first tubing string draws production fluid into the second tubing string;

an internal combustion engine;

the gas processing system being connected to receive low pressure exhaust gas from the internal combustion engine; and a pump being provided within the gas processing system, the pump having a low pressure inlet for receiving exhaust gases and the pump having a high pressure outlet, wherein said pump is a compressor and the gas processing system comprises a particulate filter followed by an exhaust cooler and exhaust separator.

4. The wellsite pumping system of claim 3 in which the exhaust cooler is followed by the exhaust separator.

5. The wellsite pumping system of claim 3 in which the first tubing string is disposed within the second tubing string.

* * * * *